US008343598B2

(12) United States Patent
Senba et al.

(10) Patent No.: US 8,343,598 B2
(45) Date of Patent: Jan. 1, 2013

(54) INK JET RECORDING MEDIUM

(75) Inventors: Tatsuo Senba, Kodaira (JP); Takeshi Tsurusaki, Funabashi (JP); Hiroshi Asakawa, Ebina (JP); Arika Nakada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/170,070

(22) Filed: Jun. 27, 2011

(65) Prior Publication Data

US 2011/0318508 A1 Dec. 29, 2011

(30) Foreign Application Priority Data

Jun. 29, 2010 (JP) ..... 2010-148209

(51) Int. Cl.
*B41M 5/00* (2006.01)

(52) U.S. Cl. ..... 428/32.21; 428/32.31

(58) Field of Classification Search ..... 428/32.21, 428/32.31

See application file for complete search history.

(56) References Cited

U.S. PATENT DOCUMENTS

| | | | | |
|---|---|---|---|---|
| 6,261,670 | B1 * | 7/2001 | Hakomori et al. | 428/32.39 |
| 2002/0121353 | A1 * | 9/2002 | Saynavajarvi | 162/199 |
| 2003/0068473 | A1 * | 4/2003 | Okumura et al. | 428/195 |
| 2003/0232210 | A1 * | 12/2003 | Haas et al. | 428/500 |
| 2005/0008728 | A1 * | 1/2005 | Wilkie et al. | 425/72.2 |
| 2005/0133175 | A1 * | 6/2005 | Hada et al. | 162/109 |

FOREIGN PATENT DOCUMENTS

| | | | |
|---|---|---|---|
| JP | 2004-268470 | A | 9/2004 |

* cited by examiner

*Primary Examiner* — Betelhem Shewareged

(74) *Attorney, Agent, or Firm* — Canon USA, Inc., IP Division

(57) ABSTRACT

An ink jet recording medium including an ink receiving layer on a substrate, wherein the MD/CD, which is a ratio of the fiber orientation in the MD direction to that in the CD direction, is 1.65 or more, and the elongation in water in the CD direction 600 seconds after start of dipping in water is 1.75% or less.

4 Claims, No Drawings

INK JET RECORDING MEDIUM

BACKGROUND OF THE INVENTION

1. Field of the Invention

The present invention relates to an ink jet recording medium.

2. Description of the Related Art

An ink jet recording medium is a recording medium having an ink receiving layer on a substrate and can exhibit good color developability and an ink absorbency when an ink is applied by an ink jet recording method. Regarding the ink jet recording medium, when an ink is applied, bumps (waviness) may occur on the surface. In order to solve such a problem, Japanese Patent Laid-Open No. 2004-268470 describes a recording medium in which the fiber orientation ratio (MD/CD) of a substrate is specified to be 1.4 or less and the elongation in water in the CD direction after 1 minute is specified to be 1.7% or less.

SUMMARY OF THE INVENTION

In a production process of an ink jet recording medium, an ink receiving layer is formed on a substrate and, thereafter, the surface of the recording medium comes into contact with a holding apparatus portion called a pass roll installed in the process. According to the studies of the present inventors, the MD/CD of the recording medium described in Japanese Patent Laid-Open No. 2004-268470 is 1.4 or less, and if a large in-process tension (tension in the MD direction) is applied, the surface may be scratched due to contact with the pass roll.

Accordingly, the present invention provides an ink jet recording medium, wherein an occurrence of bumps on the surface is suppressed and in a production process, the surface is not scratched easily.

An ink jet recording medium according to the present invention is an ink jet recording medium including an ink receiving layer on a substrate, wherein the MD/CD, which is a ratio of the fiber orientation in the MD direction to that in the CD direction, is 1.65 or more and the elongation in water in the CD direction 600 seconds after start of dipping in water is 1.75% or less.

According to the present invention, an ink jet recording medium, wherein an occurrence of bumps on the surface is suppressed and in a production process, the surface is not scratched easily.

Further features of the present invention will become apparent from the following description of exemplary embodiments.

DESCRIPTION OF THE EMBODIMENTS

A recording medium according to the present invention is an ink jet recording medium having an ink receiving layer on a substrate. Regarding the recording medium, there are a machine direction (MD direction) and a cross direction (CD direction). The MD direction refers to the direction of flow of paper in paper making and the CD direction refers to the direction perpendicular to the MD direction. In general, the fiber orientation in the MD direction and the fiber orientation in the CD direction are equalized as much as possible. That is, the ratio MD/CD of the fiber orientation in the MD direction to that in the CD direction is controlled in such a way as to come close to "1".

In the production step, the ink jet recording medium comes into a wet state and a dry state repeatedly. As a result, in after processing, e.g., coating, drying, and cutting, of the recording medium, expansion and contraction of the recording medium occur, the recording medium comes into contact with a pass roll and the like disposed in a coater and, thereby, the recording medium surface may be scratched. Meanwhile, the present inventors found that an occurrence of scratching was able to be suppressed while an occurrence of bumps on the surface was suppressed by orienting the fiber in the MD direction intentionally and, furthermore, controlling the elongation in water in the CD direction. Specifically, the ratio MD/CD of the fiber orientation in the MD direction to that in the CD direction was specified to be 1.65 or more. It was found that in the case where the fiber was oriented in such a way that the MD/CD became 1.65 or more, expansion and contraction of the recording medium in the MD direction were reduced and the surface was not scratched easily. The MD/CD is preferably 2.50 or less. In the case where the MD/CD is specified to be 2.50 or less, significant difference in the strength, e.g., the stiffness, of the recording medium depending on the direction can be suppressed. The MD/CD is particularly preferably 1.65 or more, and 2.10 or less. In the present invention, the value of the MD/CD is a value measured by an ultrasonic method. Examples of apparatuses to measure the value of the MD/CD by using the ultrasonic method include Orientation Tester SST-250 (produced by NOMURA SHOJI CO., LTD.).

Regarding the ink jet recording medium, it is important that the sheet posture after recording by an ink jet recoding method is kept flat. Changes in the sheet posture are influenced significantly by the fact that fibers in a base material are expanded and contracted while an applied ink is penetrated into the inside of the recording medium and is dried. In particular, when the recording medium is expanded and contracted in the CD direction, bumps tend to occur easily. Therefore, regarding the recording medium according to the present invention, the elongation in water in the CD direction 600 seconds after start of dipping in water is specified to be 1.75% or less. In the case where the elongation in water in the CD direction is specified to be 1.75% or less and the MD/CD is 1.65 or more, a synergistic function is exerted and, thereby, an occurrence of bumps and an occurrence of scratching of the surface can be suppressed favorably. The elongation in water can be measured with various apparatuses for measuring the elongation in water. Specific examples of apparatuses include DPM-30 (produced by emco). Regarding the measurement of the elongation in water in the CD direction in this case, the CD direction determined with Orientation Tester is assumed to be the length direction of the initial sample length, the MD direction is assumed to be the sample width direction, and the measurement is performed.

Furthermore, in the case where the elongation in water in the CD direction 30 seconds after start of dipping in water is specified to be 0.75% or less and the elongation in water in the CD direction 60 seconds after is specified to be 1.20% or less, an occurrence of fine scaly bumps can be suppressed more effectively. It is believed that fine scaly bumps are locally generated fine unevenness because the MD/CD is 1.65 or more and fiber entanglement in the CD direction is at a low level. In the present invention, an occurrence of such scaly bumps can be suppressed by controlling the elongation in water in the CD direction at early stages after start of dipping in water, as described above.

The configuration of the recording medium according to the present invention and the method for manufacturing the same will be described below in detail.

Recording Medium Substrate

In the present invention, the MD/CD of the recording medium is influenced by the MD/CD of the substrate significantly. Therefore, the MD/CD of the recording medium can be specified to be within the scope of the present invention by adjusting the MD/CD of the substrate. The range of the MD/CD of the substrate is preferably 1.65 or more, and 2.50 or less, and more preferably 1.65 or more, and 2.10 or less. The MD/CD of the recording medium can be specified to be within the scope of the present invention easily by specifying the MD/CD of the substrate within the above-described preferable range.

The substrate contains chemical pulp, e.g., LBKP, NBKP, or NBSP, mechanical pulp, e.g., GP, PGW, RMP, TMP, CTMP, CMP, or CGP, waste paper pulp, e.g., DIP, or non-wood pulp, e.g., kenaf, bagasse, or cotton, as a main material. Specifically, the content of the pulp is specified to be preferably 60 percent by mass or more, and 100 percent by mass or less. As for production of the substrate, initially, the pulp and various additives, e.g., a pigment, a binder, a sizing agent, a fixing agent, a retention aid, a cationization agent, and a paper strengthening agent, are mixed to prepare a paper stock. The paper stock may contain a pigment dispersing agent, a thickener, a fluidity improver, an antifoaming agent, a foam inhibitor, a mold release agent, a penetrant, a coloring pigment, a coloring dye, a fluorescent brightener, an ultraviolet absorbing agent, an antioxidant, an antiseptic, a fungicide, an anti-hydration agent, a dye fixing agent, and the like. Subsequently, the paper stock is subjected to paper making with various apparatuses, e.g., a Foudrinier paper machine, a cylinder paper machine, and a twin wire paper machine, to prepare a substrate.

The substrate surface may be coated or impregnated with a solution containing polymer compounds, e.g., starch, polyvinyl alcohol, and carboxymethyl cellulose, with a size press, a gate roll coater, or the like.

Ink Receiving Layer

The recording medium according to the present invention has an ink receiving layer on the substrate. The ink receiving layer can contain a pigment and a binder.

As for the pigment, examples of inorganic pigments include light calcium carbonate, heavy calcium carbonate, magnesium carbonate, kaolin, aluminum silicate, diatomaceous earth, calcium silicate, magnesium silicate, synthetic amorphous silica, colloidal silica, alumina, alumina hydrate, and magnesium hydroxide. Examples of organic pigments include styrene based plastic pigments, acrylic plastic pigments, polyethylene particles, microcapsule particles, urea polymer particles, and melamine polymer particles. These pigments may be used alone or in combination. Most of all, silica or alumina hydrate can be used from the transparency and the color developability.

As for the binder, materials capable of binding the pigments and forming coating films can be employed. Examples thereof include starch derivatives, e.g., oxidized starch, etherified starch, and phosphorylated starch; cellulose derivatives, e.g., carboxymethyl cellulose and hydroxyethyl cellulose; casein, gelatin, soybean protein, polyvinyl alcohol, and derivatives thereof; conjugated polymer latex, e.g., polyvinylpyrrolidone, maleic anhydride polymers, styrene-butadiene copolymers, and methyl methacrylate-butadiene copolymers; acrylic polymer latex, e.g., acrylic acid ester and methacrylic acid ester polymers; vinyl based polymer latex, e.g., ethylene-vinyl acetate copolymers; functional group-modified polymer latex of the above-described various binders by virtue of monomers containing functional groups, e.g., a carboxyl group; cationized products of the above-described various binders by using cationic groups and the above-described various binders having surfaces cationized by using cationic surfactants; binders produced by polymerizing the above-described various binders under cationic polyvinyl alcohol so as to distribute polyvinyl alcohol on the surface of the polymer; binders produced by polymerizing the above-described various binders in cationic colloid particle suspension dispersion so as to distribute cationic colloid particles on the surface of the polymers; aqueous binders of thermosetting synthetic polymers, e.g., melamine polymers and urea polymers; polymers and copolymers of acrylic acid esters or methacrylic acid esters, e.g., poly methyl methacrylate; and synthetic polymer based binders, e.g., polyurethane polymers, unsaturated polyester polymers, vinyl chloride-vinyl acetate copolymers, polyvinyl butyrals, and alkyd polymers. These binders may be used alone or in combination. Most of all, polyvinyl alcohol can be used. The polyvinyl alcohol can be synthesized by, for example, hydrolyzing a polyvinyl acetate.

The binder content of the ink receiving layer is preferably 20.0 percent by mass or less relative to the pigment from the viewpoint of the ink absorbency, and is more preferably 15.0 percent by mass or less. In order to bind the pigment and form a coating favorably, the content is preferably 1.0 percent by mass or more.

The ink receiving layer can contain at least one of boric acid and a borate. In the case where the ink receiving layer contains boric acid or a borate, an occurrence of cracking of the ink receiving layer can be suppressed. The content of boric acid is preferably 0.5 percent by mass or more, and 15.0 percent by mass or less relative to the total mass of binder in the ink receiving layer.

The ink receiving layer can be formed by applying an ink receiving layer coating solution. The ink receiving layer coating solution may contain additives in the related art, e.g., a pigment dispersing agent, a fastness improver, an antioxidant, an organic solvent, an antiseptic, a pH regulator, a surfactant, and an antifoaming agent, in addition to the above-described pigments and binders. In the case where a casting treatment is performed, in order to peel the ink receiving layer from a cast drum mirror-finished surface smoothly, aliphatic acids, e.g., stearic acid and oleic acid, aliphatic hydrocarbons, e.g., paraffin wax and polyethylene wax, and the like may be contained as mold release agents.

Undercoat Layer

The recording medium according to the present invention may have an undercoat layer between the substrate and the ink receiving layer. The undercoat layer is formed by, for example, applying an undercoat layer coating solution on the substrate. The undercoat layer can contain a pigment and a binder.

As for the pigment, examples of inorganic pigments include light calcium carbonate, heavy calcium carbonate, magnesium carbonate, kaolin, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, alumina hydrate, aluminum hydroxide, lithopone, zeolite, and hydrated halloysite. Examples of organic pigments include styrene based plastic pigments, acrylic plastic pigments, polyethylene particles, microcapsule particles, urea polymer particles, and melamine polymer particles. These pigments may be used alone or in combination.

Examples of binder include the same binders as those mentioned as the binders which may be contained in the ink receiving layer. The content of the binder is preferably 5.0 percent by mass or more, and 500.0 percent by mass or less relative to the pigment.

The undercoat layer may contain a white pigment and a fluorescent dye to adjust the degree of whiteness and the color. When these are contained in the undercoat layer, in order to optimize the feeling and the vision of a recorded image on the recording medium, adjustment can be performed in such a way that a slightly pale appearance is caused.

Others

In order to obtain the feeling suitable for application to photograph and good conveying performance in a recording apparatus, the thickness of the ink jet recording medium is preferably 100 μm or more, and 300 μm or less. If the thickness is less than 100 μm, the stiffness is at a low level for the ink jet recording medium and the feeling is at a low level for application to photograph. If the thickness exceeds 300 μm, the stiffness is high for the ink jet recording medium and the conveying performance in a recording apparatus may be degraded.

In order that the above-described stiffness is specified to be within an appropriate range, the Taber stiffness (JIS P 8125) is specified to be preferably 0.2 mN·m or more, and 5.0 mN·m or less. The Taber stiffness is more preferably 0.5 mN·m or more, and 4.0 mN·m or less. Examples of methods for adjusting the Taber stiffness include a method in which the blend ratio of loading materials in a paper layer serving as a substrate is adjusted and a method in which a water-holding polymer or the like is added, besides the above-described method in which the thickness of a recording medium is adjusted. If the Taber stiffness is less than 0.2 mN·m, the feeling becomes at a low level for application to photograph because of low stiffness and, in addition, curling is not controlled easily because of small resistance to expansion and contraction of the substrate resulting from absorption of ink after recording. If the Taber stiffness exceeds 5.0 mN·m, the conveying performance in a recording apparatus may be degraded.

Method for Manufacturing Recording Medium
Substrate

In the present invention, the paper stock is subjected to paper making with various apparatuses, e.g., a Foudrinier paper machine, a cylinder paper machine, and a twin wire paper machine. Examples of methods for adjusting the MD/CD that is the fiber orientation ratio of the substrate include a method in which the flow of the paper stock in a head box is controlled, a method in which the ratio (J/W ratio) of the speed of ejection of a pulp slurry to a paper machine wire portion to the wire speed, and a method in which the shaking condition of a wire is controlled. Specific methods for controlling the flow include a method in which a paper stock diffusion bar or partition plates are installed in a path from the head box to a slice outlet and a method in which the degree of opening of the slice outlet is changed in the width direction.

The properties and the fluidity of the pulp slurry on the basis of the characteristics of the pulp fiber and the internal additives are also factors that cause changes in MD/CD and, therefore, the MD/CD of the recording medium may be specified to be a desired value by adjusting them appropriately.

Among the above-described items, the J/W ratio is mentioned as the factor which particularly exerts an influence on the MD/CD of the substrate and the recording medium. However, it is difficult to specify in a wholesale manner because the factor depends on various sheet production conditions, e.g., paper-making speed and a paper-making configuration, and facilities in many cases. For example, in the case where the cylinder paper machine is used as a paper-making machine, an increase and decrease in rotation speed of a mold cylinder also exerts a significant influence on the MD/CD of the substrate and the recording medium obtained. Furthermore, the MD/CD of the substrate and the recording medium can be increased by increasing the tension in the MD direction during press or drying with a dryer.

The freeness of the substrate is preferably 400 ml CSF (Canadian Standard Freeness) or more, and 700 ml CSF or less, and more preferably 450 ml CSF or more, and 650 ml CSF or less. If the freeness is less than 400 ml CSF, dehydration on the wire becomes slow and the productivity may be reduced. Furthermore, the value of MD/CD may be reduced. If 700 ml CSF is exceeded, degradation in surface quality for the ink jet recording medium may occur because of degradation in smoothness of the substrate and paper break may occur in application of a coating solution because of reduction in tensile strength. The method for adjusting the freeness of the substrate is not specifically limited. Examples thereof include a method in which pulp fibers are beaten with equipment, e.g., a refiner.

Undercoat Layer

In the case where the undercoat layer is formed, an undercoat layer coating solution is applied by using, for example, the following various coating apparatuses. Examples thereof include various blade coaters, roll coaters, air knife coaters, bar coaters, rod blade coaters, curtain coaters, gravure coaters, die coaters by using an extrusion system, coaters by using a slide hopper system, and size press. Application is performed on-machine or off-machine. The coating solution is dried with, for example, hot-air dryers, e.g., a linear tunnel dryer, an arch dryer, an air loop dryer, and a sign-curve air float dryer, and various dryers by using infrared rays, heating dryers, microwaves, or the like.

Ink Receiving Layer

In the present invention, the ink receiving layer can be formed by applying an ink receiving layer coating solution to the substrate and performing drying. The ink receiving layer coating solution can be applied by the following coating methods in such a way as to obtain an appropriate amount of application. That is, various curtain coaters, coaters by using an extrusion system, coaters by using a slide hopper system, and the like are mentioned. Application can be performed on-machine or off-machine. For the purpose of, for example, adjusting the viscosity of the coating solution, the coating solution may be heated in the application, or a coater head may be heated. The coating solution can be dried with, for example, hot-air dryers, e.g., a linear tunnel dryer, an arch dryer, an air loop dryer, and a sign-curve air float dryer, and various dryers by using infrared rays, heating dryers, microwaves, or the like.

The amount of application of the ink receiving layer coating solution is preferably 5 $g/m^2$ or more, and 40 $g/m^2$ or less in terms of dry solid content. In the case where the amount is 5 $g/m^2$ or more, a good ink absorbency can be exhibited. In the case where the amount is 40 $g/m^2$ or less, a load in the cost can be reduced. The amount is more preferably, 10 $g/m^2$ or more, and 35 $g/m^2$ or less.

In the manufacturing method according to the present invention, the recording medium (ink receiving layer) surface in a wet state can be contact-bonded to a contact-bonding surface for drying and, thereby, the surface can be subjected to restrained drying. Examples of methods for contact-bonding the surface to the contact-bonding surface for drying include a method in which contact-bonding to a tabular press machine is performed and a method in which contact-bonding is performed with a Yankee dryer, a multicylinder dryer, or a drum-shaped press machine. In particular, a casting method can be employed in which the surface coated with the coating solution is dried while being contact-bonded to a heated metal surface in the shape of a drum with a mirror-finished surface.

As for the casting method, there are three typical methods described in the following items (a) to (c).

(a) A direct method in which an ink receiving layer coating solution is applied to a substrate and the ink receiving layer in a wet state is contact-bonded to a heated cast drum, so as to be dried.

(b) A rewet casting method (indirect method) in which an ink receiving layer coating solution is applied to a substrate, an ink receiving layer is brought into a dry or semidry state once, a cast treatment solution containing water as a primary component is applied to the ink receiving layer, so as to return the ink receiving layer to a state having plasticity (wet state), and thereafter, contact-bonding to a heated cast drum is performed, so as to dry.

(c) A coagulation method in which an ink receiving layer coating solution is applied to a substrate, a cast treatment solution containing a coagulating agent, e.g., an acid, is applied to the ink receiving layer in a wet state, so as to bring the ink receiving layer into a gel state having no fluidity, and thereafter, contact-bonding to a heated cast drum is performed, so as to dry.

Any one of these casting methods can be used in the case where a recording medium capable of forming a photographic tone image is produced. However, in order to obtain high glossiness, the rewet casting method and the coagulation method can be used.

Regarding the coagulation method, an ink receiving layer coating solution is applied to a substrate, and a treatment solution to coagulate or cross-link a binder in an ink receiving layer is applied while the ink receiving layer is in a wet state. For example, in the case where polyvinyl alcohol is used as the binder, a treatment solution containing a boron compound can be used. In particular, sodium borate, boric acid, or both of them in combination can be employed. Furthermore, a cationic macromolecule or the like may be added as a dye fixing agent. In order that the ink receiving layer is peeled from the cast drum mirror-finished surface smoothly, a mold release agent can be added. A treatment solution containing them is applied and, thereafter, is contact-bonded to the cast drum mirror-finished surface, followed by drying. Consequently, the recording surface exhibits good glossiness.

Regarding the rewet casting method, a coating solution can contain water as a primary component, and a dye fixing agent and a mold release agent can be added appropriately, as in the coagulation method. Moreover, a surfactant may be added within the bounds of not impairing the surface tension of the coating solution and the permeability into the ink receiving layer and the substrate.

Regarding the cast drum used in the casting methods described in the items (a) to (c), as in the production condition of common cast coat paper, the surface roughness, the surface temperature, the diameter, the linear pressure, and the speed can be selected appropriately. The drum surface temperature is specified to be preferably 80° C. or higher, and 120° C. or lower. If the drum surface temperature is lower than 80° C., the glossiness of a glossy surface may be reduced. If the drum surface temperature exceeds 120° C., the ink receiving layer contact-bonded to the cast drum may be heated rapidly, and boiling may occur on the surface or in the inside of the ink receiving layer. In this case, the ink receiving layer do not easily adhere to the cast drum, copying of the cast drum mirror-finished surface may become insufficient, and the glossiness may be impaired.

The casting method can be employed because restrained drying is performed in such a way that the ink receiving layer in a wet state is contact-bonded to a heated cast drum mirror-finished surface, so as to dry and, therefore, drying shrinkage is very small as compared with that in unrestrained drying, e.g., a floating dryer. Meanwhile, in the case where the humidity is controlled with steam, damping, or the like for the purpose of curling adjustment and moisture adjustment of the recording medium, expansion and contraction of the recording medium occur easily in moisture absorption and moisture desorption during the process. The expansion and contraction generated at this time cause uneven contraction of the recording medium and, thereby, bumps may occur in the process in which an ink penetrates into the substrate through the ink receiving layer and evaporates from the ink receiving layer surface in recording by an ink jet recording method. Consequently, regarding even the recording medium, wherein the casting method is used and the MD/CD is specified to be 1.65 or more, bumps may occur. In the present invention, bumps are suppressed by specifying the elongation in water of the recording medium in the CD direction 600 seconds after start of dipping in water to be 1.75% or less. Examples of methods for specifying the elongation in water in the CD direction 600 seconds after start of dipping in water to be 1.75% or less include a method in which a sizing agent is contained in the substrate to an extent not inhibiting the ink absorption and a method in which loading materials, e.g., an inorganic pigment, in paper and internal agents, e.g., dimension stabilizer, are added.

Examples of sizing agents include internal sizing agents serving as sizing agents added to a pulp slurry obtained in a production process of the substrate and surface sizing agents serving as sizing agents applied to the substrate surface after the substrate is obtained. Examples of internal sizing agents include rosin based sizing agents, fortified rosin based sizing agents, alkylketene dimer based neutral sizing agents, and alkenyl succinic anhydride based neutral sizing agents. Examples of surface sizing agents include water-soluble polymers, e.g., starch and polyvinyl alcohol, and various sizing agents mentioned as the internal sizing agents. These sizing agents may be used alone or a plurality of types may be used in combination. The amount of addition of the internal sizing agent is preferably 0.01 percent by mass or more, and 5.0 percent by mass or less relative to total mass of pulp, and more preferably 0.05 percent by mass or more, and 3.0 percent by mass or less. The amount of addition of the surface sizing agent is preferably 0.01 $g/m^2$ or more, and 10.00 $g/m^2$ or less on one substrate surface basis, and more preferably 0.03 $g/m^2$ or more, and 5.00 $g/m^2$ or less on one surface basis. The internal sizing agent is a factor which particularly exerts an influence on the elongation in water in the CD direction 600 seconds after start of dipping in water, and as the amount of addition of the internal sizing agent increases, the elongation in water in the CD direction 600 seconds after start of dipping in water tends to decrease. Meanwhile, the surface sizing agent is not only a factor which particularly exerts an influence on the elongation in water in the CD direction 60 seconds after start of dipping in water, as described later, but also a factor which exerts an influence on the elongation in water in the CD direction 600 seconds after. As the amount of addition of the surface sizing agent increases, the elongations in water in the CD direction 60 seconds and 600 seconds after start of dipping in water tend to decrease. Therefore, in the present invention, the internal sizing agent and the surface sizing agent can be used in combination.

The content of the loading material in paper in the substrate is preferably 1 percent by mass or more, and 40 percent by mass or less, and more preferably 5 percent by mass or more, and 25 percent by mass or less. If the content of the loading material in paper is less than 1 percent by mass, an effect of suppressing expansion and contraction in the CD direction exerted by the loading material in paper is not obtained easily and, in addition, the stiffness of the recording medium increases, so that the conveying performance may be reduced. If 40 percent by mass is exceeded, the amount of generation of paper powder increases, so that formation of a good image may be difficult, or the conveying performance of the recording medium may be reduced. The elongation in water in the CD direction 600 seconds after start of dipping in water decreases with respect to the restrained drying, such as, drying on a cast drum, but increases if the moisture content of the sheet in an unrestrained state is fluctuated. Therefore, it is effective to suppress fluctuation of moisture content of the recording medium after being peeled from the cast drum and employ a large angle of embrace of a pass roll in a step in which the moisture content is fluctuated, so as to increase the retention time and the restraint force in the CD direction.

Furthermore, in the case where the elongation in water in the CD direction 30 seconds after start of dipping in water is specified to be 0.75% or less and the elongation in water in the CD direction 60 seconds after is specified to be 1.20% or less, an occurrence of small scaly bumps can be suppressed favorably. In order to specify the elongation in water in the CD direction 30 seconds after start of dipping in water to be 0.75% or less and specifying the elongation in water in the CD direction 60 seconds after start of dipping in water to be 1.20% or less, the following method can be performed in addition to the method for controlling the elongation in water in the CD direction 600 seconds after start of dipping in water. Examples thereof include a method in which loading materials, e.g., an inorganic pigment, in paper and internal agents, e.g., dimension stabilizer, are added and a method in which the conditions of the casting process and back-end processes thereof are controlled. The expansion and contraction in the CD direction at early stages after start of dipping in water are influenced easily by the restrained drying time on the cast drum, the moisture content of the sheet when being peeled from the drum, the moisture absorption and moisture desorption behavior during the downstream steps of humidity control, cutting, and the like, the tension in the step at that time, and the state of holding with respect to the pass roll and the like. The elongation in water in the CD direction 60 seconds after start of dipping in water also decreases with respect to the restrained drying, such as, drying on the cast drum, but increases if the moisture content of the sheet in an unrestrained state is fluctuated, as in the elongation in water in the CD direction 600 seconds after start of dipping in water. Therefore, it is effective to suppress fluctuation of moisture content of the recording medium after being peeled from the cast drum and employ a large angle of embrace of a pass roll in a step in which the moisture content is fluctuated, so as to increase the retention time and the restraint force in the CD direction.

In general, regarding the recording medium in the form of a roll, the winding direction is the MD direction. In general, regarding the form cut into a standardized size, e.g., a flat sheet, an A4-size, or an L-size, in the case where the recording medium is long grain, the long side is the MD direction and in the case where the recording medium is short grain, the short side is the MD direction. In this regard, it can be determined that the orientation direction of most fibers is the MD direction on the basis of the orientation angles measured with Orientation Tester SST-250. As described above, the CD direction is a direction perpendicular to the MD direction.

EXAMPLES

The present invention will be described below more specifically with reference to the examples.

Substrate 1

The freeness of a slurry (containing 100.0 percent by mass of LBKP) was adjusted to be 450 ml CSF and 15.0 parts by mass of light calcium carbonate, 2.0 parts by mass of cationized starch, and 0.300 parts by mass of alkylketene dimer based neutral sizing agent were added. The resulting slurry (paper stock) was diluted with ion-exchanged water to have a solid concentration of 0.5 percent by mass and was ejected to a wire portion which was shaking at a J/W ratio of 1.07, so as to perform paper making, where a Foudrinier multicylinder paper machine was used.

Subsequently, a mixed solution containing 100.0 parts by mass of ion-exchanged water, 5.0 parts by mass of oxidized starch, and 0.100 parts by mass of alkylketene dimer based surface sizing agent was applied to both surfaces of the resulting paper with a size press in such a way that the solid content became 4.0 g/m$^2$ on one surface basis, followed by drying. In this manner, Substrate 1 having a basis weight of 150.0 g/m$^2$ was obtained.

Substrate 2

Substrate 2 was obtained in the same manner as Substrate 1 except that paper making was performed while the wire portion of the Foudrinier multicylinder paper machine was not shaken.

Substrate 3

Substrate 3 was obtained in the same manner as Substrate 1 except that paper making was performed by using a multicylinder paper machine.

Substrate 4

Substrate 4 was obtained in the same manner as Substrate 3 except that the amount of addition of the alkylketene dimer based neutral sizing agent was specified to be 0.500 parts by mass.

Substrate 5

Substrate 5 was obtained in the same manner as Substrate 1 except that the amount of addition of the alkylketene dimer based surface sizing agent was specified to be 0.025 parts by mass.

Substrate 6

Substrate 6 was obtained in the same manner as Substrate 1 except that the amount of addition of the alkylketene dimer based surface sizing agent was specified to be 0.050 parts by mass.

Substrate 7

Substrate 7 was obtained in the same manner as Substrate 1 except that the J/W ratio was specified to be 1.00.

Substrate 8

Substrate 8 was obtained in the same manner as Substrate 7 except that the amount of addition of the alkylketene dimer based neutral sizing agent was specified to be 0.500 parts by mass.

Undercoat Layer

An undercoat layer was formed on the resulting substrate in a manner described below. Initially, 70.0 parts by mass of light calcium carbonate, 20.0 parts by mass of kaolin, 10.0 parts by mass of titanium oxide, and 20.0 parts by mass of binder (15.0 parts by mass of styrene-butadiene based latex, 5.0 parts by mass of starch) were prepared. These were added to ion-exchanged water, so as to obtain a composition having a solid concentration of 60.0 percent by mass. The resulting composition was applied to one surface of the substrate with a blade coater in such a way that the dry application amount became 10.0 g/m$^2$ and drying was performed, so as to obtain a substrate with an undercoat layer having a basis weight 160.0 g/m$^2$.

Preparation of Ink Receiving Layer Coating Solution A

Ion-exchanged water was blended with 50.0 parts by mass of spherical colloidal silica particles (trade name: PL-7, produced by FUSO CHEMICAL CO., LTD.) and 50.0 parts by mass of synthetic silica (trade name: A300, produced by NIPPON AEROSIL CO., LTD.) in such a way that the solid concentration became 18.0 percent by mass. Furthermore, dispersion was performed with a high pressure homogenizer to obtain Colloidal sol A.

Meanwhile, polyvinyl alcohol (trade name: PVA235, produced by Kuraray Co., Ltd., degree of polymerization: 3,500, degree of saponification: 88%) was dissolved into ion-exchanged water to obtain an 8.0 percent by mass polyvinyl alcohol aqueous solution. The resulting polyvinyl alcohol aqueous solution was mixed with Colloidal sol A in such a way that polyvinyl alcohol became 20.0 percent by mass relative to the pigment, so as to prepare Ink receiving layer coating solution A.

Preparation of Ink Receiving Layer Coating Solution B

An alumina hydrate (trade name: Dispersal HP14, produced by Sasol) was added to ion-exchanged water in such a way that the solid concentration became 30.0 percent by mass. Subsequently, 1.5 parts by mass of methanesulfonic acid was added relative to 100.0 parts by mass of the resulting alumina hydrate and agitation was performed to obtain colloidal sol. The resulting colloidal sol was diluted with ion-exchanged water appropriately in such a way that the solid concentration of the alumina hydrate became 27.0 percent by mass, so as to obtain Colloidal sol B.

Meanwhile, polyvinyl alcohol (trade name: PVA235, produced by Kuraray Co., Ltd., degree of polymerization: 3,500, degree of saponification: 88%) was dissolved into ion-exchanged water to obtain an 8.0 percent by mass polyvinyl alcohol aqueous solution. The resulting polyvinyl alcohol aqueous solution was mixed with Colloidal sol B in such a way that polyvinyl alcohol became 10.0 percent by mass relative to the alumina hydrate. Then, 3.0 percent by mass boric acid aqueous solution was mixed in such a way that boric acid became 2.0 percent by mass relative to the alumina hydrate, so as to prepare Ink receiving layer coating solution B.

Preparation of Cast Treatment Solution C

As for a treatment solution, 3.0 parts by mass of boric acid, 0.2 parts by mass of citric acid, and 0.5 parts by mass of polyethylene emulsion (trade name: Polymaron 618, produced by CHUKYO YUSHI CO., LTD.) were added relative to 100 parts by mass of ion-exchanged water, so as to prepare Cast treatment solution C.

Cast Treatment Solution D

As for a treatment solution, 2.0 parts by mass of polyethylene emulsion (trade name: Polymaron 618, produced by CHUKYO YUSHI CO., LTD.) and 0.2 parts by mass of surfactant (trade name: Surfynol 465, produced by Nissin Chemical Industry Co., Ltd.) were added relative to 100 parts by mass of ion-exchanged water, so as to prepare Cast treatment solution D.

Example 1

Ink receiving layer coating solution A was applied to Substrate 1 by using a roll coater in such a way that the dry solid amount became 20.0 g/m$^2$. Casting by the coagulation method was performed, wherein Cast treatment solution C was applied uniformly all over the surface of the ink receiving layer in the wet state, and contact bonding to a heated cast drum having a mirror-finished surface and drying were performed. As for the casting condition, the cast drum temperature was specified to be 95° C. and the nip pressure in contact bonding was specified to be 130 kg/cm$^2$. After casting, water was applied from the surface opposite to the surface subjected to the casting by the coagulation method with a damping apparatus by using a two-fluid spray nozzle. After the water was applied, restrained drying was performed on a cylinder dryer, so as to obtain an ink jet recording medium of Example 1.

The amount of moisture of the ink jet recording medium in each step was measured on the basis of JIS P 8127. The results were as described below.

After drying with cast drum: 6.0 percent by mass
After damping: 7.5 percent by mass
After drying with cylinder dryer: 5.0 percent by mass Example 2

An ink jet recording medium of Example 2 was obtained in the same manner as Example 1 except that Substrate 1 in Example 1 was changed to Substrate 2.

Example 3

An ink jet recording medium of Example 3 was obtained in the same manner as Example 1 except that Substrate 1 in Example 1 was changed to Substrate 3.

Example 4

An ink jet recording medium of Example 4 was obtained in the same manner as Example 1 except that Substrate 1 in Example 1 was changed to Substrate 4.

Example 5

Ink receiving layer coating solution B was applied to Substrate 3 by using a die coater in such a way that the dry solid mass became 20.0 g/m$^2$ and dying was performed. Thereafter, casting by the rewet method was performed, wherein Cast treatment solution D was applied uniformly all over the surface of the ink receiving layer to bring about a wet state, and contact bonding to a heated cast drum having a mirror-finished surface and drying were performed. An ink jet recording medium of Example 5 was obtained in the same manner as Example 1 except that described above.

Example 6

An ink jet recording medium of Example 6 was obtained in the same manner as Example 1 except that Substrate 1 in Example 1 was changed to Substrate 5.

Example 7

An ink jet recording medium of Example 7 was obtained in the same manner as Example 1 except that Substrate 1 in Example 1 was changed to Substrate 6.

Comparative Example 1

An ink jet recording medium of Comparative example 1 was obtained in the same manner as Example 1 except that Substrate 1 in Example 1 was changed to Substrate 7.

Comparative Example 2

An ink jet recording medium of Comparative example 2 was obtained in the same manner as Example 1 except that Substrate 1 in Example 1 was changed to Substrate 8.

Comparative Example 3

An ink jet recording medium of Comparative example 3 was obtained in the same manner as Comparative example 1 except that the cylinder dryer in Comparative example 1 was changed to air floating type hot air drying. In this regard, the air floating type hot air drying of the recording medium was performed without restraining the recording medium.

Comparative Example 4

An ink jet recording medium of Comparative example 4 was obtained in the same manner as Comparative example 3 except that Substrate 7 in Comparative example 3 was changed to Substrate 3.

Comparative Example 5

An ink jet recording medium of Comparative example 5 was obtained in the same manner as Comparative example 3 except that Substrate 7 in Comparative example 3 was changed to Substrate 4.

Evaluation

The ink jet recording medium obtained in each of Examples and Comparative examples was evaluated as described below. The results thereof are shown in Table 1.

(1) Elongation in Water in CD Direction

The elongation in water in the CD direction was measured with the measuring apparatus and the measurement condition described below.

Measuring apparatus: DPM-30 (produced by emco)

Measurement condition: DDPM module: clamp type (spring tension: 1 g/mm)

Sample width (MD direction): 15 mm, initial sample length (CD direction): 50 mm

Measurement of a displacement of the sample length after a laps of predetermined seconds (30 seconds, 60 seconds, 600 seconds) from dipping into pure water at 23° C.

(2) Fiber Orientation Ratio MD/CD

The fiber orientation ratio MD/CD was measured with the measuring apparatus and the measurement condition described below.

Measuring apparatus: SST-250 (produced by NOMURA SHOJI CO., LTD.)

Measurement condition: 23° C., 50% RH (3) Bumps

Each recording medium was cut into an A4-size. An image was recorded thereon by using an ink jet recording apparatus (trade name: PIXUS MP990, produced by CANON KABUSHIKI KAISHA) in Glossy Pro Platinum Grade mode (standard setting, no frame). As for the image, a solid image of (R, G, B)=(0, 0, 0) in an RGB mode of PhotoShop7.0 was recorded all over the surface.

The above-described image was used and bumps on the recording medium surface were evaluated visually on the basis of the following criteria.

AA: After a lapse of 10 seconds from completion of recording and after 24 hours of standing in an atmosphere at 23° C. and 50% RH, no bumps were observed.

A: After a lapse of 10 seconds from completion of recording, no bumps were observed, but after 24 hours of standing in an atmosphere at 23° C. and 50% RH, small scaly bumps were observed slightly.

B: After a lapse of 10 seconds from completion of recording and after 24 hours of standing in an atmosphere at 23° C. and 50% RH, small scaly bumps were observed slightly.

C: After a lapse of 10 seconds from completion of recording, small scaly bumps were observed slightly, and after 24 hours of standing in an atmosphere at 23° C. and 50% RH, scaly bumps were observed clearly.

D: After a lapse of 10 seconds from completion of recording, scaly bumps were observed clearly.

(4) Scratch in Ink Receiving Layer

Regarding 100 sheets of recording medium cut into an A4-size, the record surfaces in a white paper state before recording were observed visually, and occurrences of scratches in the ink receiving layers in a white paper state were evaluated. Regarding recording medium having no scratches in the ink receiving layer, an image was recorded by using an ink jet recording apparatus (trade name: PIXUS MP990, produced by CANON KABUSHIKI KAISHA) in Glossy Pro Platinum Grade mode (standard setting, no frame). As for the image, a solid image of (R, G, B)=(0, 0, 0) in an RGB mode of PhotoShop7.0 was recorded all over the surface. After the recording, occurrences of scratches in the ink receiving layer was evaluated visually again. The evaluation criteria were as described below.

AA: Regarding both the white paper state and the state in which the black solid image was recorded, no scratches were observed in the ink receiving layer.

A: Regarding the white paper state, no scratches were observed in the ink receiving layer, but regarding the state in which the black solid image was recorded, scratches were observed.

B: Regarding both the white paper state and the state in which the black solid image was recorded, scratches were observed in the ink receiving layer, but the scratches were 5 or less per A4-sized sheet.

C: Regarding the white paper state, 5 or less of scratches per A4-sized sheet were observed in the ink receiving layer, but regarding the state in which the black solid image was recorded, 6 or more scratches per A4-sized sheet were observed.

The above-described results are shown in Table 1 collectively.

TABLE 1

| | Elongation in water | | | Fiber orientation | | |
|---|---|---|---|---|---|---|
| | After 30 sec (%) | After 60 sec (%) | After 600 sec (%) | ratio MD/CD | Bump | Scratch |
| Example 1 | 0.630 | 0.960 | 1.660 | 1.650 | AA | B |
| Example 2 | 0.650 | 0.960 | 1.660 | 1.840 | A | A |
| Example 3 | 0.650 | 0.970 | 1.670 | 2.050 | A | AA |
| Example 4 | 0.550 | 0.850 | 1.500 | 2.050 | AA | AA |
| Example 5 | 0.750 | 1.200 | 1.750 | 2.050 | A | AA |
| Example 6 | 0.850 | 1.320 | 1.670 | 1.650 | B | B |
| Example 7 | 0.810 | 1.120 | 1.660 | 1.650 | B | B |
| Comparative example 1 | 0.630 | 0.950 | 1.650 | 1.460 | AA | C |
| Comparative example 2 | 0.560 | 0.850 | 1.500 | 1.460 | AA | C |
| Comparative example 3 | 0.910 | 1.380 | 2.050 | 1.460 | D | C |
| Comparative example 4 | 1.160 | 1.500 | 2.160 | 2.050 | D | A |
| Comparative example 5 | 0.860 | 1.210 | 1.880 | 2.050 | C | A |

As shown in Table 1, regarding ink jet recording medium of each of Examples 1 to 7, the evaluations of both the bump and the scratch were better than or equal to B. In particular, regarding recording media of Examples 1 to 5, in which the elongation in water in the CD direction 30 seconds after start of dipping in water was specified to be 0.75% or less and the elongation in water in the CD direction 60 seconds after start of dipping in water was specified to be 1.20% or less, the bump and the scratch exhibited better results.

Meanwhile, regarding the ink jet recording medium of each of Comparative examples 1 to 3, in which the MD/CD was less than 1.65, the evaluation result of the scratch was C. Regarding the ink jet recording medium of each of Comparative examples 3 to 5, in which the elongation in water in the CD direction 600 seconds after start of dipping in water exceeded 1.75%, the evaluation result of the bump was C or D.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-148209 filed Jun. 29, 2010, which is hereby incorporated by reference herein in its entirety.

What is claimed is:

1. An ink jet recording medium comprising:

an ink receiving layer on a substrate, wherein a ratio of a fiber orientation in a machine direction of the recording medium to a fiber orientation in a cross direction of the recording medium is 1.65 or more, and wherein an elongation in water in the cross direction of the recording medium 600 seconds after start of dipping in water is 1.75% or less.

2. The ink jet recording medium according to claim 1, wherein the elongation in water in the cross direction of the recording medium 30 seconds after start of dipping in water is 0.75% or less and the elongation in water in the cross direction of the recording medium 60 seconds after start of dipping in water is 1.20% or less.

3. The ink jet recording medium according to claim 1, wherein the ratio of the fiber orientation in the machine direction of the recording medium to the fiber orientation in the cross direction of the recording medium is 2.50 or less.

4. The ink jet recording medium according to claim 1, wherein the ratio of the fiber orientation in the machine direction of the recording medium to the fiber orientation in the cross direction of the recording medium is measured by an ultrasonic method.

* * * * *